US005273074A

United States Patent [19]

Conradt et al.

[11] Patent Number: 5,273,074

[45] Date of Patent: Dec. 28, 1993

[54] MULTIFUNCTION MULTIPORT SLIDER VALVE

[75] Inventors: Hilmar Conradt, Wüfrath; Ernst-August Meyer, Algermissen, both of Fed. Rep. of Germany

[73] Assignee: Mannesmann Aktiengesellschaft GmbH, Düsseldorf, Fed. Rep. of Germany

[21] Appl. No.: 734,632

[22] Filed: Jul. 23, 1991

[30] Foreign Application Priority Data

Jul. 24, 1990 [DE] Fed. Rep. of Germany ..... 4023806

[51] Int. Cl.[5] ..... F15B 13/043

[52] U.S. Cl. ..... 137/625.64; 137/269; 137/270; 137/625.66

[58] Field of Search ..... 137/269, 270, 625.64, 137/625.66

[56] References Cited

U.S. PATENT DOCUMENTS

| | | | |
|---|---|---|---|
| 3,902,526 | 9/1975 | Brake et al. | 137/625.64 |
| 4,074,689 | 2/1978 | Lenay | 137/270 |
| 4,524,803 | 6/1985 | Stoll et al. | 137/625.64 |
| 5,086,803 | 2/1992 | Nakajima | 137/625.64 |

FOREIGN PATENT DOCUMENTS

| | | | |
|---|---|---|---|
| 0093359 | 11/1983 | European Pat. Off. | 137/625.66 |
| 0093360 | 11/1983 | European Pat. Off. | 137/625.66 |
| 0198234 | 10/1986 | European Pat. Off. . | |
| 0341604 | 11/1989 | European Pat. Off. . | |
| 3216705 | 11/1983 | Fed. Rep. of Germany . | |
| 3216809 | 11/1983 | Fed. Rep. of Germany . | |
| 3249616 | 5/1988 | Fed. Rep. of Germany . | |
| 3815855 | 7/1989 | Fed. Rep. of Germany . | |
| 2933704 | 11/1989 | Fed. Rep. of Germany . | |
| 2339115 | 8/1977 | France . | |
| 364152 | 10/1962 | Switzerland . | |

*Primary Examiner*—Gerald A. Michalsky
*Attorney, Agent, or Firm*—Horst M. Kasper

[57] ABSTRACT

A casing bore (29) running parallel to a valve center longitudinal axis (5), with cross bores is furnished at a second longitudinal side of a multifunction multiport slider valve with a valve casing, with a sealed connector plane (3) furnished at a first longitudinal side (2) for supply lines, control lines, user lines and ventilation lines, and with a corresponding support plate. In order to increase the number of functions performed by the multiport slider valve and to easily adjust said slider valve, the casing bore (29) is subdivided into two longitudinal sections (29*a*, 29*b*) with individual cross bores (30). Turnable and displaceable sealing discs (32), furnished with openings (33), are disposed in front of the joined ports (31) of the cross bore (30), and cross channels (36), and connected to the pressure line (P), the control line (Z, X), the ventilation lines (R or S) are led starting from the longitudinal side (2) into the two separate longitudinal sections (29*a*, 29*b*) of the casing fore (29). The individual cross channels (36) are set in each case to the respective opening or closing function by way of a single-piece floor seal (4).

15 Claims, 8 Drawing Sheets

II
II
II

II
22
23a
24
21
25
20
26
27
28
29
30
52
31
9
19
3
2
1
4
Y
8
S
11
12
18
29b
7
B
32a
35
17
P
32
34
29a
A
R
16
14
15
10
13
5

MULTIFUNCTION MULTIPORT SLIDER VALVE

BACKGROUND OF THE INVENTION

1. Field of the Invention

The invention relates to a multifunction multiport slider valve, in particular for gaseous media, including a valve casing. The valve casing exhibits on a first longitudinal side a sealed connection plane for fluidic supply lines, control lines, user lines and ventilation lines and which is furnished with a support plate including corresponding connection channels. A valve sleeve is disposed centered relative to the valve center longitudinal axis. The valve sleeve is furnished with annular seals, coordinated to each passage channel. The valve sleeve is furnished with a valve slider disposed coaxially to the valve sleeve. A casing bore, running parallel to the valve center axis, is disposed at a second longitudinal side. The second longitudinal side extends parallel and opposite to the first longitudinal side. Cross bores, directed perpendicular to the valve center longitudinal axis, run from the casing bore and adjoin at the second longitudinal side. At least the casing bore can be blocked off.

Such fluidic multiport slider valves are constructed and formed for a fixed number of functions. An expansion of the number of functions is therefore no longer possible after finished production of the slider valve.

Such a fluidic multiport slider valve is known from the European Patent A2-0,198,234 with a valve casing, which exhibits a flat connector plane with sealing plate for a standard component valve support plate, called Europa plate or ISO plate, and which is furnished at the oppositely disposed longitudinal side with a further connector plane for solenoid valves. Such a 5/2-way valve or a 5/3-way valve takes already into consideration that the connector openings in the support plate are unchangeably fixed and in addition are axially increasingly staggered in the two axle directions of the valve and that, in addition, the individual pressure chambers are to be switched substantially without crossover during the switching of the valves. The known solution evolves from the assumption that such valves are constructed axially relatively long and that the construction of the valve sleeve is particularly complicated and comprised of a plurality of plugged-together plastic parts. Correspondingly, production, mounting and assembly of the valve are particularly expensive. In addition, the requirement for a maximum passage of fluids is not or only unsatisfactorily resolved. However, a 5/3-way valve function is not possible in one and the same valve casing in case of the 5/2-way valve formed by the known multiport valve. In order to avoid these recognized disadvantages, it has been proposed in the past that a casing bore be disposed parallel to the valve center longitudinal axis, where cross bores, directed perpendicular to the valve center longitudinal axis, run from the casing bore and join at the second longitudinal side, of which bores at least the casing bore can be blocked off. Cover groove is milled into a valve cover for this purpose and a sealing ring disc is inserted between a casing intermediate ring and the valve cover. Two lower control channels can be disposed axially staggered relative to the two upper control channels such that in each case only the lower control channels or the upper control channels are connected via the corresponding cover grooves at the casing recess based on a rotation by 180 degrees, of the casing cover together with the respective sealing ring discs, while simultaneously the other control channels are blocked based on the sealing ring discs.

Such a system, however, can only be handled with difficulty by the customer acquiring the valve and it is difficult to install and it provides only a switching from the lower to the upper control channel. In addition, it is not possible with this conventional valve to perform the mounting and demounting of such casing covers at the customer location, because this could impair the functional capabilities of these conventional slider valves.

SUMMARY OF THE INVENTION

1. Purposes of the Invention

It is an object of the present invention to furnish a multifunction multiport slider valve, i.e. a slider valve, which is formed and constructed to perform a variety of functions, which can be installed at the customer location acquiring the slider valve without large expenditure, and which can be switched by performing only simple adjustments for certain function by the customer himself.

It is another object of the present invention to provide multifunction multiport slider valve, which is well adapted to a standard port structure.

It is yet a further object of the present invention to provide a multifunction multiport slider valve which allows an easy switching at the customer location between various flows at various ports of the slider valve.

These and other objects and advantages of the present invention will become evident from the description which follows.

2. Brief Description of the Invention

The present invention provides for a multifunction multiport slider valve. A valve casing includes a first longitudinal side and a second longitudinal side. A sealed connection plane is disposed on the first longitudinal side of the valve casing. Fluidic supply lines, control lines, user lines and ventilation lines are disposed on the sealed connection plane. A support plate is provided with connection channels in each case corresponding to the supply lines, the control lines, the user lines, and the ventilation lines. A valve sleeve is disposed centered relative to a valve center longitudinal axis. The valve sleeve is furnished with ring seals coordinated to each passage channel. A valve slider is disposed at the valve sleeve and directed co-axially to the valve sleeve. A casing bore is running parallel to the valve center longitudinal axis at the second longitudinal side. The second longitudinal side is disposed parallel and opposite to the first longitudinal side. The casing bore, running parallel to the valve center longitudinal axis, is divided into two separate longitudinal sections. A center sealing disc and outer sealing discs are disposed at the second longitudinal side of the valve casing. Independent cross-bores are provided in each longitudinal section. The cross bores are directed perpendicular to the valve center longitudinal axis, running from the casing bore, and are joined at the second longitudinal side. At least the casing bore is blocked by blocking means. A sealing disc is furnished with a passage and disposed in each case in front of the joined openings of the cross bores. The cross channels are connected to the pressure line, to the control line, and to the ventilation lines and are led from the first longitudinal side to the two separate longitudinal sections of the casing bore. A single-piece floor seal seals and adjusts the individual cross channels to a respective opening or closing function. The single-piece floor seal is laterally turned around a center symmetry axis such that, in combination with the casing bore, divided into two longitudinal sections, and the center sealing disc and the outer sealing discs, several valve functions are easily set in combination with the casing bore.

The structure can be constructed for operating on gaseous media.

The two separate longitudinal sections of the casing bore can be fluidically connected and isolated, respectively, by way of the center sealing disc. A peripheral channel can be disposed at the center sealing disc. The peripheral channel can extend over an angle of about 180 degrees. The recesses can be disposed at the valve casing and can be staggered against each other by 90 degrees. A projection can be formed at the center sealing disc. The projection can grip in each case into the respective recesses.

The outer sealing discs, disposed in the area a casing covers, can be furnished in front of the cross bores. The cross bores can be joined in pairs at the second longitudinal side. A ball can be disposed between the cross bores and can subdivide one longitudinal section. At least one pilot valve can be attached by way of screws in case of removed outer sealing discs. The pilot valve can serve for purposes of electric control.

A passage flow opening and a closure stopper for the pressure line can be provided symmetrically to the symmetry axis at the single-piece floor seal.

Removable stoppers can be provided at least at the positions of the control lines and of the ventilation lines at the single-piece floor seal, resting adjacent to the first longitudinal side.

The multifunction multiport slider valve of the present invention furnishes that the casing bore, running parallel to the valve center longitudinal axis, is subdivided into two separate longitudinal sections. Each longitudinal section exhibits independent cross bores, which cross bores join at the second longitudinal side. In each case a sealing disc, furnished with a passage opening, is disposed in front of the joining ends of the cross bores. Cross channels, which start at the first longitudinal side and which are connected to the pressure line, the control line, the ventilation lines, are led up to the two separate longitudinal sections of the casing bore. The individual cross channels are set to the opening or closing function in each case by way of a single-piece floor seal. The single-piece floor seal can be turned to the side around a center symmetry axis such that several valve functions can be easily adjusted, in combination with the casing bore subdivided into two longitudinal sections and in connection with the sealing disc and the outer sealing discs. For the installation of a selected valve function, it is in general only required on the customer side that the sealing means are repositioned in a described position. It is, however, not required that the casing covers be removed and that very difficultly operable seals be changed. The setting of the selected valve functions is consequently easy and also can be performed by less qualified personnel.

The simple construction of the invention multifunction multiport slider valves includes further that the two separate longitudinal sections of the casing bore can be connected or separable for flow technical purposes by a center sealing disc.

Along to this line, it is further provided, that the center sealing disc is furnished with a peripheral channel, which extends over an angle of about 180 degrees and that a protrusion is formed at the center sealing disc. The protrusion grips and engages the respective sections, which sections are provided at the valve casing staggered by 90 degrees relative to each other.

The multiplication of the functions is further supported in that outer sealing discs are disposed in the area of a casing cover in front of pairwise cross bores joining at the second longitudinal side, wherein the one longitudinal section is subdivided by way of a ball disposed between the cross bores.

A further increase of the function selection is achieved in that one or two pilot valves can be attached by way of screws, in case of removed outer sealing discs wherein the pilot valves serve for providing an electrical control.

According to further multiplication of the functions of the multifunction multiport slider valve, it is achieved that the single-piece floor sealing is furnished symmetrically to the symmetry axis with a passage opening for the pressure line and that the multifunction multiport slider valve is furnished with a closure stopper cork. The respective turning or changing of the single-piece floor seal, however, results in that the pressure line is either closed or opened and released.

The multiplication of the number of available functions is further supported by having removable stoppers disposed at the single-piece floor seal resting at the first longitudinal side at least at the positions of the control lines and of the ventilation lines. The floor seal, made of plastifiable synthetic material or plastics, can in this case itself exhibit stoppers with the preset break position. These stoppers can easily be removed by persons of ordinary skills in the art performing the installation without any particular auxiliary tools.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

In the accompanying drawings, in which are shown several of the various possible embodiments of the present invention.

DESCRIPTION OF INVENTION AND PREFERRED EMBODIMENTS

Figure 1:
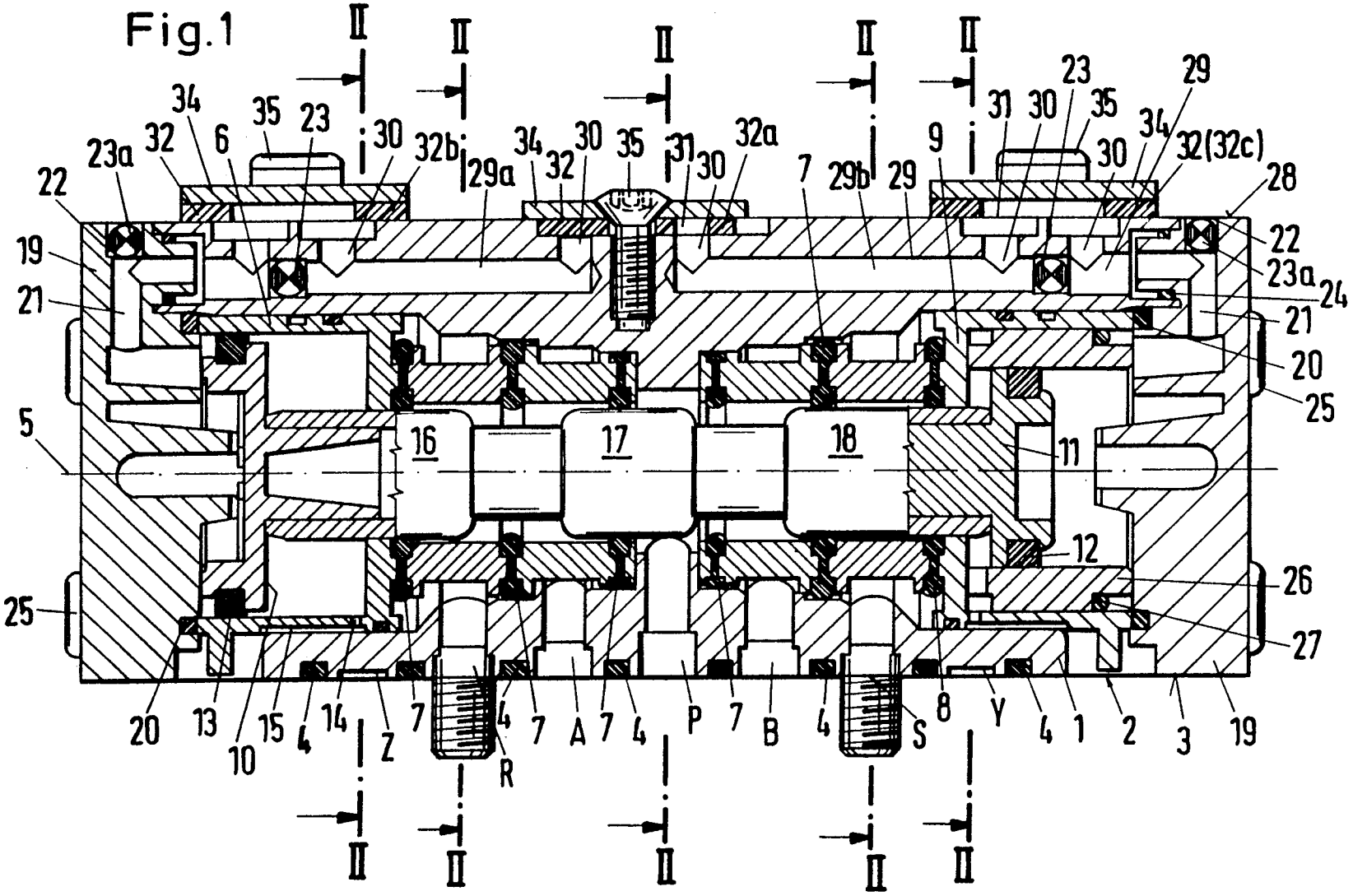
FIG. 1 is a view of an axial longitudinal section through the multifunction multiport slider valve.
Figure 1A:
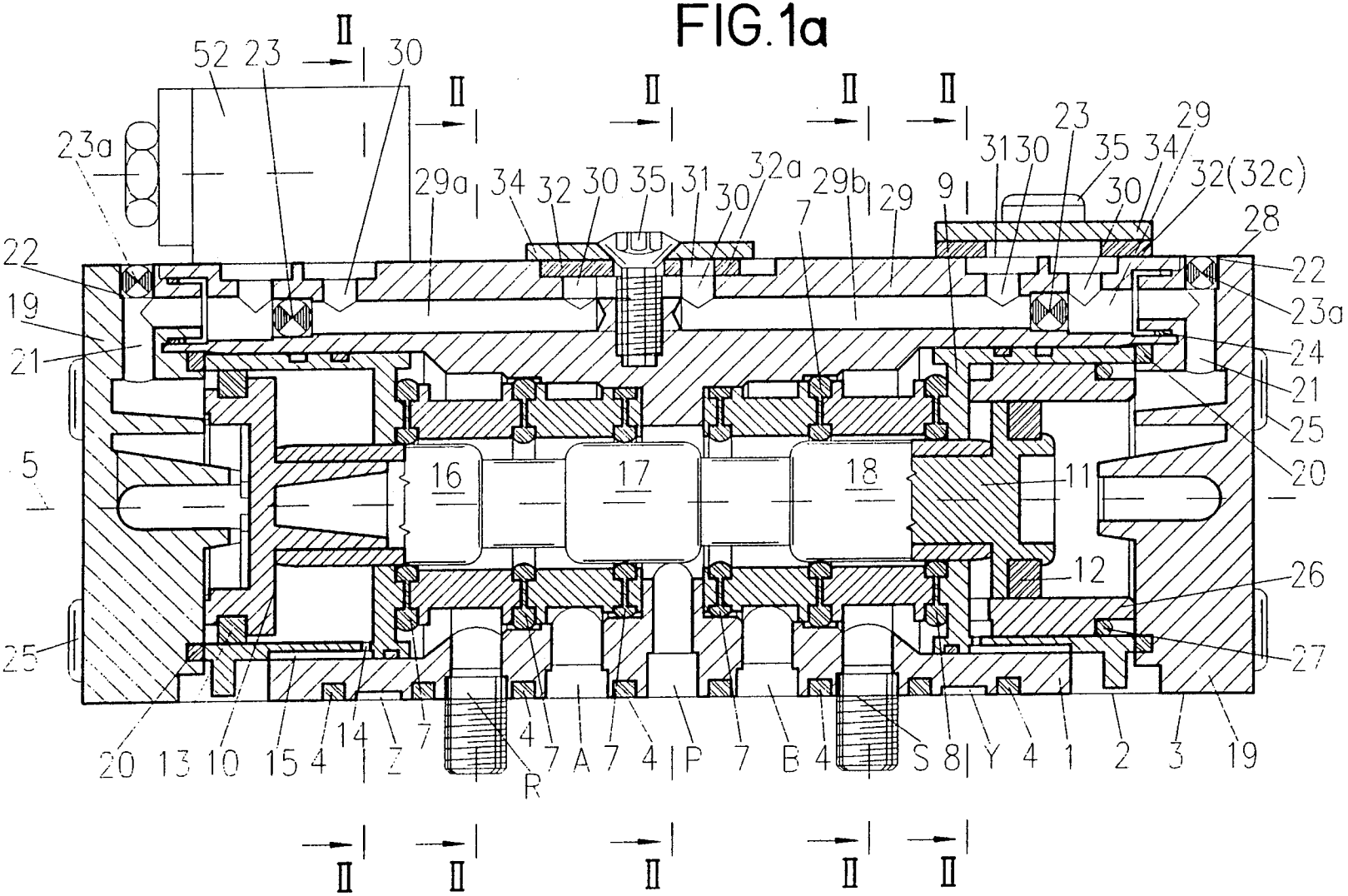
FIG. 1*a* shows a further embodiment in an axial longitudinal section through a multifunction multiport slider valve including one pilot valve.
Figure 1B:
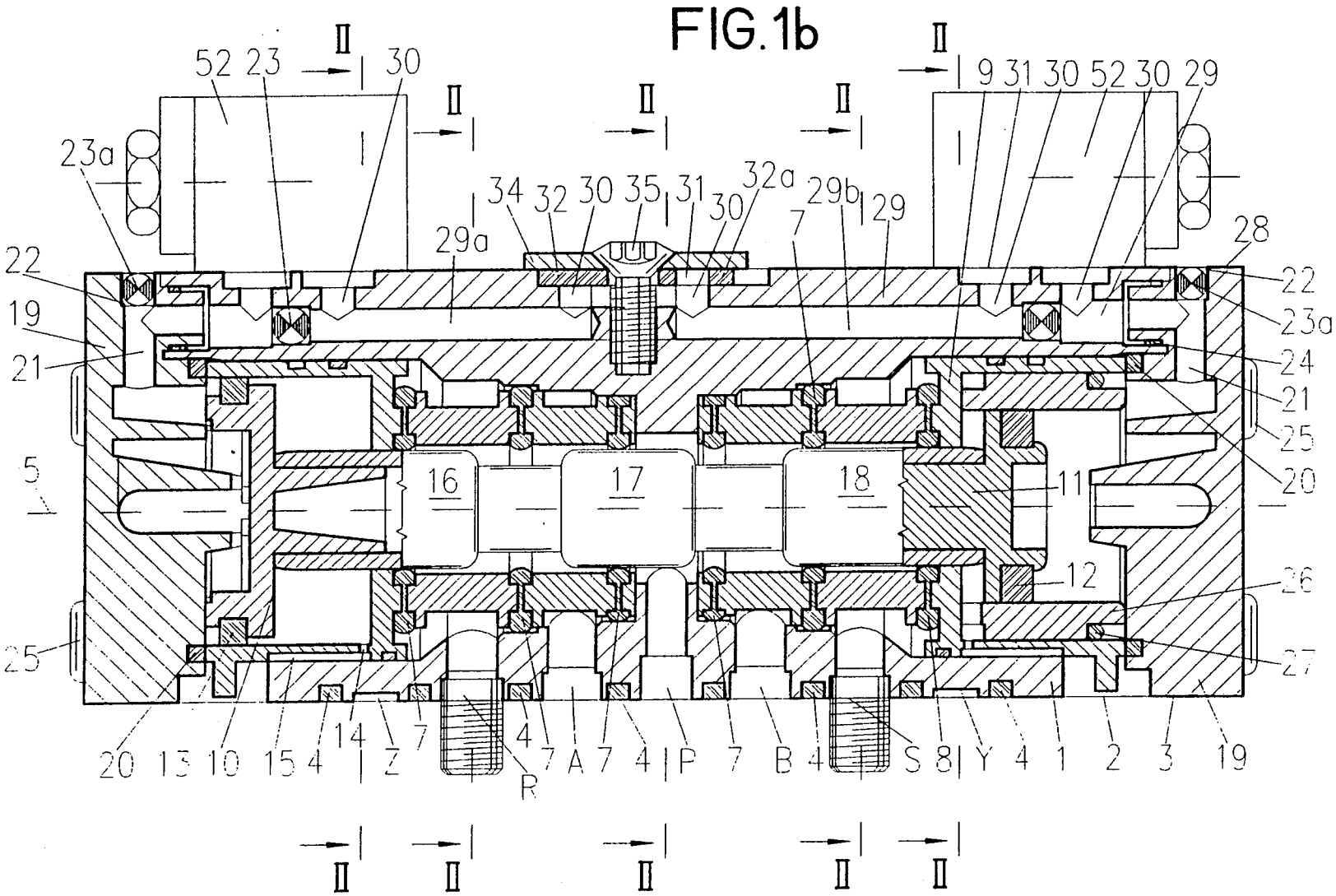
FIG. 1*b* shows a view of a further embodiment in an axial longitudinal section through a multifunction multiport slider valve including one pilot valve.
Figure 1C:
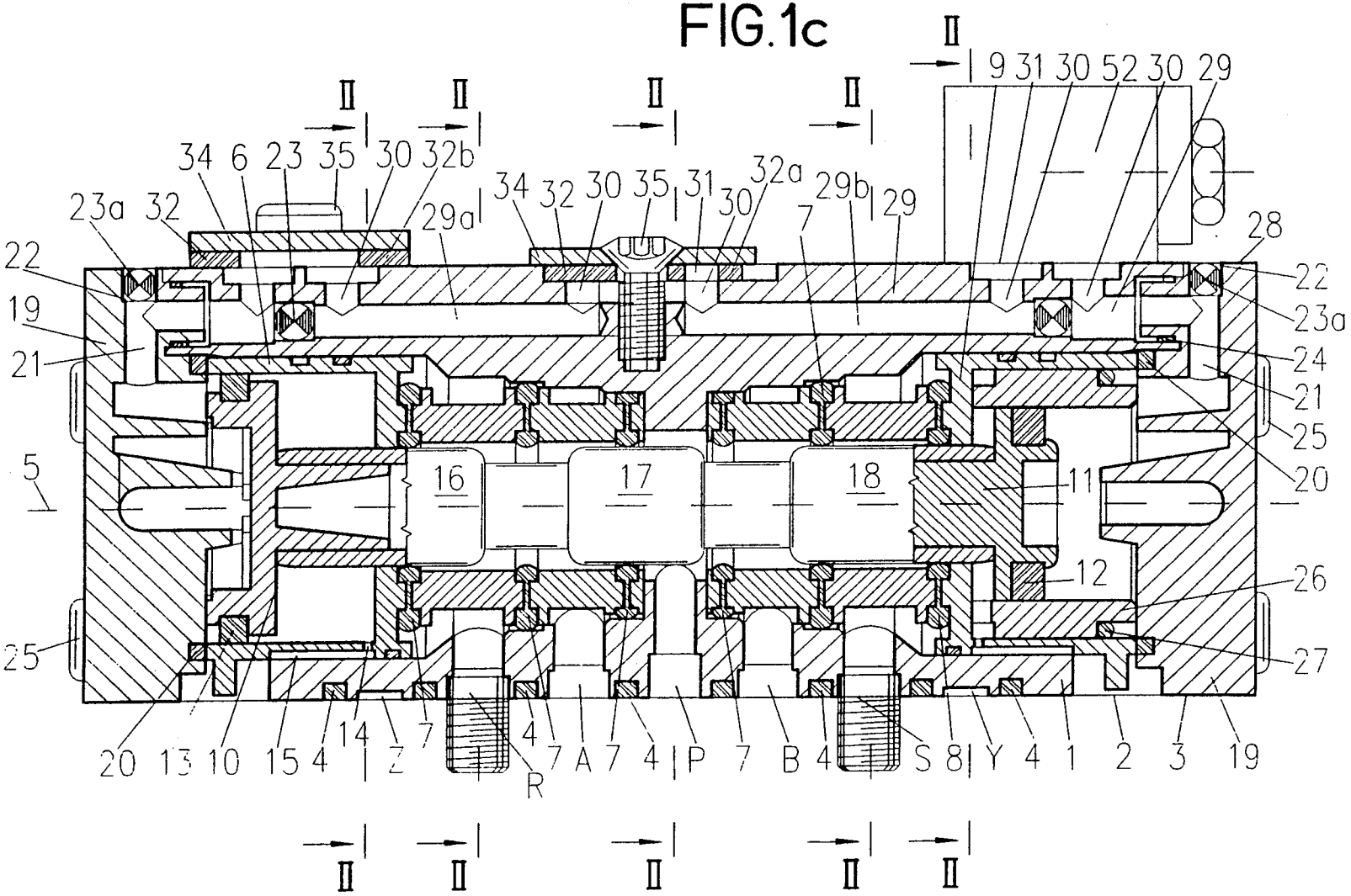
FIG. 1*c* shows a view of a further embodiment in an axial longitudinal section through a multifunction multiport slider valve including two pilot valves.

The present invention provides a multifunction multiport slider valve, in particular for gaseous media, with a valve casing. The valve casing can include a sealed connection plane for fluidic supply lines, control lines, user lines and ventilation lines at a first longitudinal side. A support plate, including corresponding connection channels can be provided for this purpose. A valve sleeve can be disposed centered relative to a valve center longitudinal axis. The valve sleeve can be furnished with ring seals coordinated to each passage channel. The valve sleeve can be furnished with a valve slider disposed coaxially to the valve sleeve. A casing bore can be run parallel to the valve center longitudinal axis at a second longitudinal side. The second longitudinal side can be disposed parallel and opposite to the first longitudinal side. The cross bores, directed perpendicular to the valve center longitudinal axis, can run from the casing bore and can be joined at the second longitudinal side. At least the casing bore can be blocked from the cross bores. The casing bore 29, running parallel to the valve center longitudinal axis 5, can be subdivided into two separate longitudinal sections 29*a*, 29*b*. Each longitudinal section 29*a*, 29*b* can exhibit independent cross bores 30. The cross bores 30 can be joined at a second longitudinal side 28. In each case a sealing disc 32, furnished with a passage 33, can be disposed in front of the joined openings 31 of the cross bores 30. The cross channels 36, connected to the pressure line P, to the control line Z, X, and to the ventilation lines R or S can be led from the first longitudinal side 2 to the two separate longitudinal sections 29*a*, 29*b* of the casing bore 29. The individual cross channels 36 can be adjusted by way of a single-piece floor seal 4 to the respective opening or closing function. The single-piece floor seal 4 can be laterally turned around a center symmetry axis 48 such that several valve functions can be easily set in combination with the casing bore 29, subdivided into two longitudinal sections 29*a*, 29*b*, and the center sealing disc 32*a* and the outer sealing discs 32*b* and 32*c*.

The two separate longitudinal sections 29*a*, 29*b* of the casing bore 29 can be fluidically connected or separated 20 by way of the center sealing disc 32*a*.

The center sealing disc 32*a* can be furnished with a peripheral channel 38. The peripheral channel 38 can extend over an angle of about 180 degrees. A projection 39 can be formed at the center sealing disc 32*a*. The projection 39 can grip in each case into respective sections 40, which sections 40 can be furnished at the valve casing 1 and can be staggered against each other by 90 degrees.

The outer sealing discs 32*b*, 32*c*, disposed in the area of a casing cover 19, can be furnished in front of cross bores 30, joining in pairs at the second longitudinal side 28. The one longitudinal section 29*a*, 29*b* can be subdivided by way of a ball 23 disposed between the cross bores 30.

One or two pilot relay valve 52 can be attached by way of screws 35 in case of removed outer sealing discs 32*b*, 32*c*. The pilot relay valves 52 can serve for purposes of electric control.

The single-piece floor seal 4 can be furnished symmetrically to the symmetry axis 48 with a passage flow opening 49 and with a closure stopper 50 for the pressure line P.

The single-piece floor seal 4, resting adjacent to the first longitudinal side 2, can include removable stoppers 51 at least at the positions of the control lines Z, X and of the ventilation lines R, S.

The multifunction multiport slider valve can be used for fluids and in particular for gaseous media, for example air. A valve casing 1 exhibits at a first longitudinal side 2 a sealed flat connector plane 3 for a fluidic supply line P, for user lines A and B, for ventilation lines R and S as well as for control lines Z and Y. A further, standard component valve support plate 53, which is also designated as "Europa-Plate", or internationally standardized as "ISO-Plate," is resting at this connector plane 3 under insertion of floor seal 4. Slot-shaped, cross-directed openings of connector channels, corresponding to and disposed opposite to the lines Z,Y; R,S; A,B and P, are inserted, recessed and/or incorporated into the standard component valve support plate 53.

The valve casing 1 receives a left valve sleeve 6, disposed centrically relative to the valve center longitudinal axis 5. On the left valve sleeve 6, ring seals 7 are coordinated to the respective passage channel corresponding to the lines Z, Y, R, S, A, B and P. The last seal ring 8 in the sequence rests against a right valve sleeve 9. A valve piston 10 is guided in the left valve sleeve 6 and a valve piston 11 is guided in the right valve sleeve 9. The valve piston 11 exhibits a piston seal 12 and the valve piston 10 exhibits a piston seal 13. In addition, a ventilation bore 14 and a ventilation groove 15 are incorporated into the two valve sleeves 6 and 9. The slider sections are designated with reference numerals 16, 17 and 18. As is conventional in such constructions, the annular channels guiding the flow are running in between the side sections. In each case, a cover 19 with seal ring 20 closes the valve casing 1 at the left end and at the right end of the valve casing 1. An air channel 21 is disposed within the cover 19, where the production technologically required branch 22 of the cover 19 is closed with a pressed-in ball 23*a*. Correspondingly, a further cover 19 closes the valve casing 1 at the right end of the valve casing 1 with the already described features. The covers 19 are sealed by sealing rings 24 relative to the valve casing 1 and are attached by way of screws.

An inner sleeve 26 with a seal 27 is disposed within the right valve sleeve 9. A casing bore 29 is disposed at a second longitudinal side 28, which second longitudinal side 28 is disposed parallel and opposite to the first longitudinal side 2 and which second longitudinal side is disposed parallel to the valve center longitudinal axis 5, for expanding the number of functions, wherein a user can himself perform the change to a different function. Cross bores 30 run from this casing bore 29 perpendicular to the valve center longitudinal axis 5 where the cross bores 30 join at the second longitudinal side 28.

Figure 4:
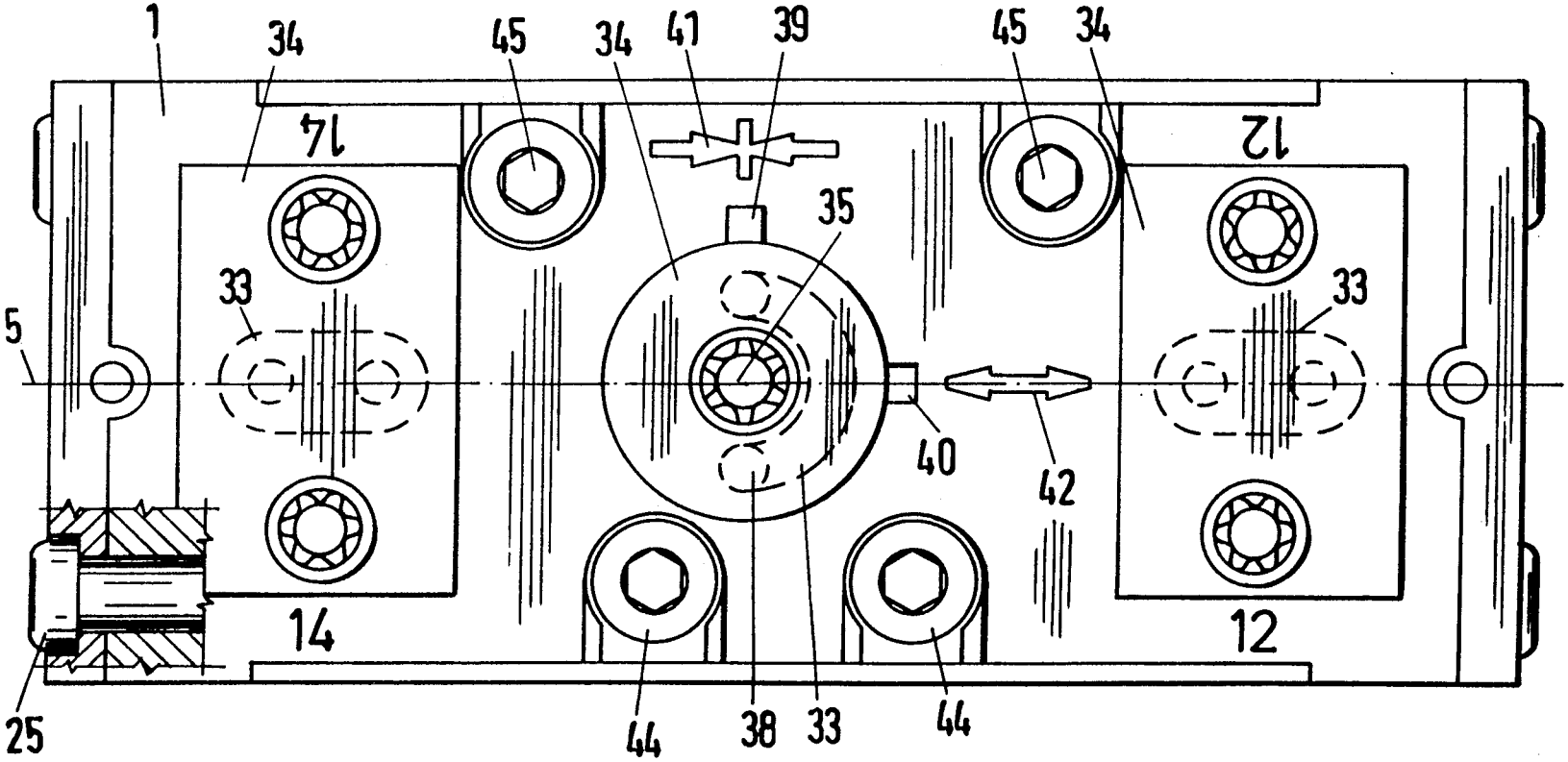
FIG. 4 is a top plan view onto the upper side of the valve casing.
Figure 5:
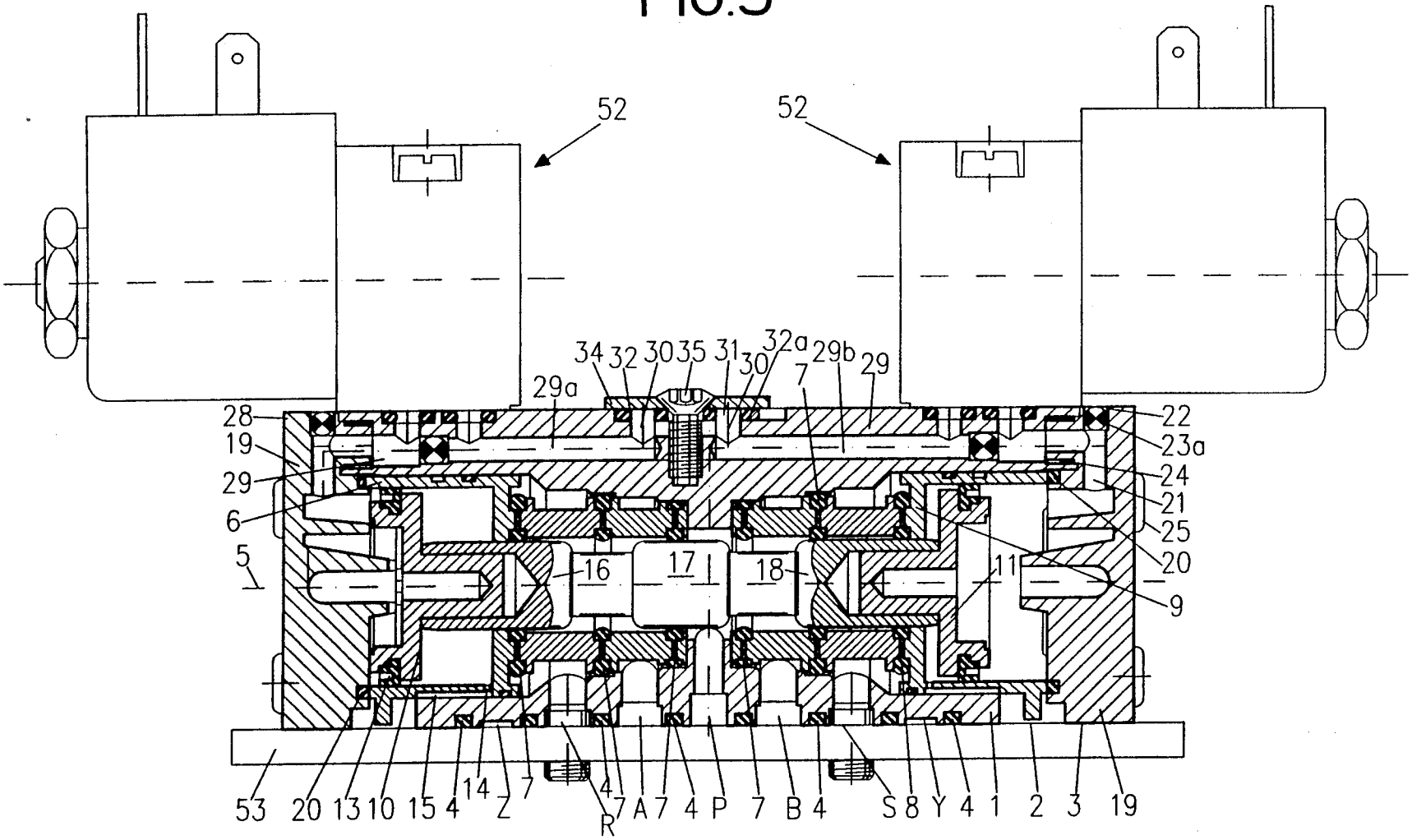
FIG. 5 shows a view of a further embodiment in an axial longitudinal section through a multifunction multiport slider valve including two pilot valves.

The casing bore hole 29, running parallel to the valve center longitudinal axis 5, is subdivided into two separate longitudinal sections 29*a* and 29*b*. Each longitudinal section 29*a*, 29*b* exhibits autonomous cross bores 30 with joined openings 31. Sealing discs 32 are disposed in front of these joined openings 31. The sealing discs 32 exhibit at least one passage 33 for in each case one cross bore 30, as illustrated in FIG. 4. The sealing discs 32 are maintained in position by discs 34, and the discs 34 are maintained in their selected position by screws 35.

Figure 2:
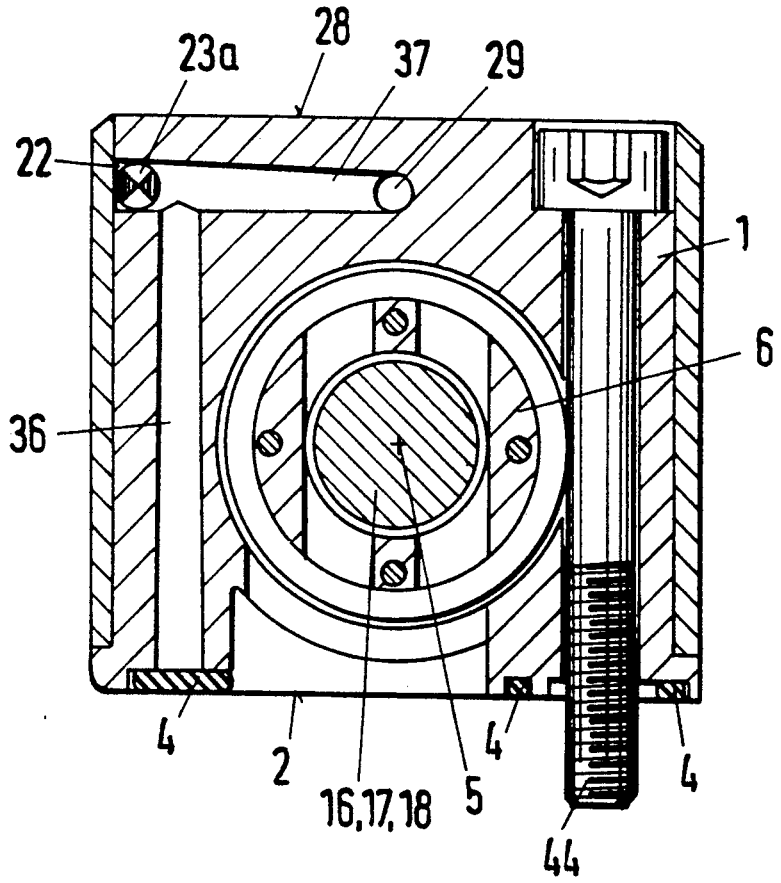
FIG. 2 is a cross-section along section lines II—II of the embodiment of FIG. 1 in the plane of the connections: control lines Z, Y; ventilation lines R, S; and fluidic supply line P.

Cross channels 36, as illustrated in FIG. 2, are disposed in each case in the section planes II—II according to FIG. 1, which cross channels 36 are in connection via a connection channel 37 with the separated longitudinal sections 29*a* and 29*b*.

The two separated longitudinal sections 29*a*, 29*b* of the casing bore 29 can be fluidically connected to each other by way of a central sealing disc 32*a* or are separated as illustrated in FIG. 1. The current and fluidic connection between the two separated longitudinal sections 29*a*, 29*b* is generated by peripheral channel 38, illustrated in FIG. 4, wherein one of the two cross bores 30, which is illustrated in FIG. 1 as the left cross bore, is covered. A projection 39, disposed at the sealing disc, can engage into a recess 40 by releasing of the screw 35 and by turning the sealing disc 32*a* by 90 degrees, such that the flow passage is either blocked, as illustrated by symbol 41, or is released as illustrated by symbol 42.

Correspondingly, outer sealing discs 32*b* and 32*c* are disposed in the area of a casing cover 19. The cross bores 30, separated in each case by a ball 23, separate the one longitudinal section 29*a* or 29*b* into two further sections, wherein the connection of the cross bores 30 can be produced by use of the discs 34 together with one of the sealing discs 32*b*, 32*c*. In case of removed outer sealing discs 32*b*, 32*c*, the precontrol valves can be flanged at the position of the sealing discs 32*b*, 32*c* in order to produce or to block the connection of the cross bores 30 by electrical pulse.

The valve casing 1 is connected by way of in each case two screw pairs 44 and 45 with the standard component valve support plate. The screw pairs 44 and 45 in each case run through passage hole pairs 46 and 47, disposed at differing distances.

Figure 3:
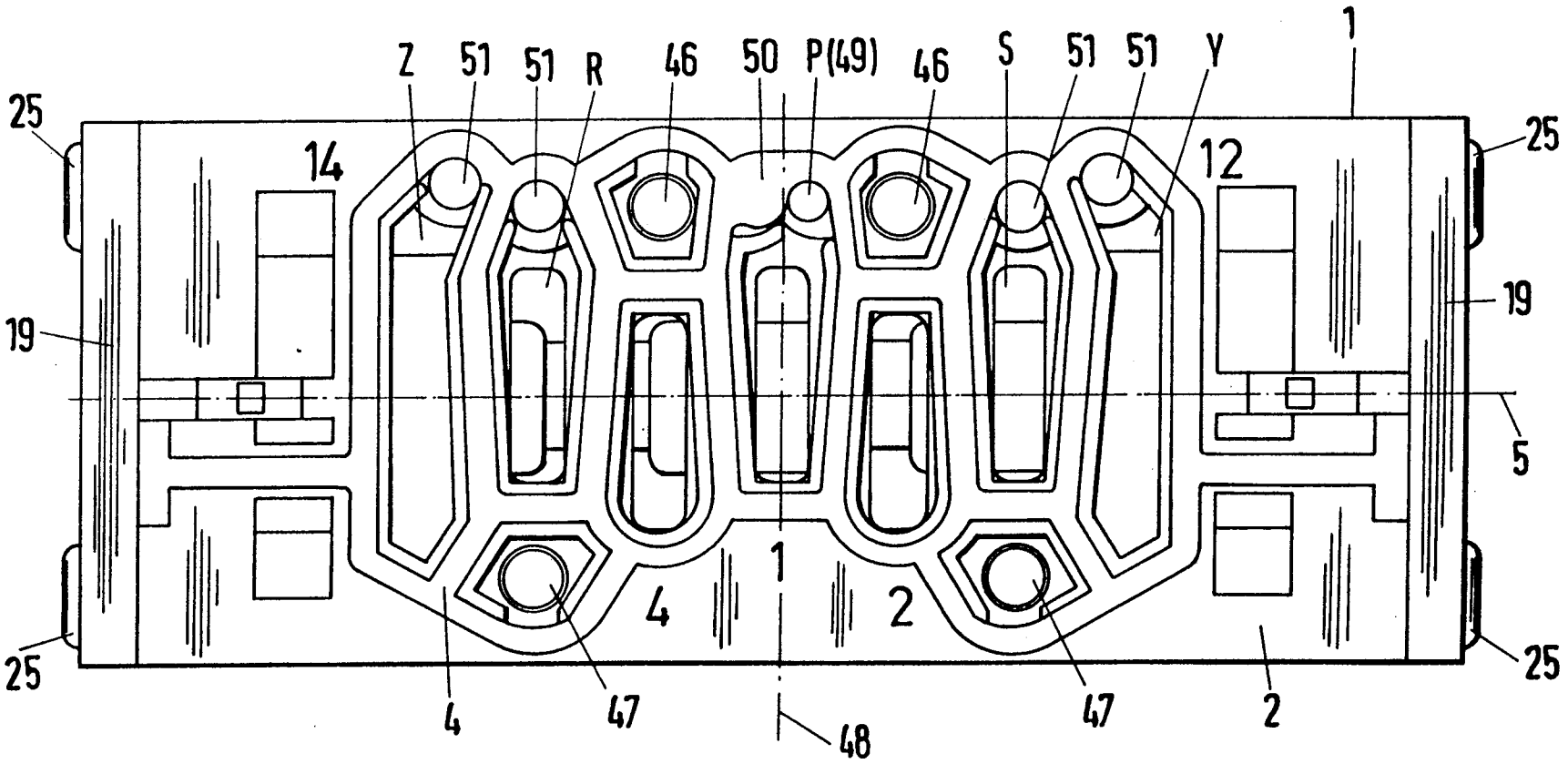
FIG. 3 is a bottom plan view against the valve casing.

The single-piece floor seal 4, disposed at the lower side of the valve casing 1, is illustrated in FIG. 3 in a hatched manner of a material made of plastic or rubber. The single-piece floor seal 4 is formed symmetrically relative to the symmetry axis 48. The individual cross channels 46 are therefore adjusted via this single-piece floor seal 4 to the respective opening function or closing function. The single-piece floor sealing 4 can be turned around the center symmetry axis 48 to the side such that in combination with the casing bore, subdivided in two longitudinal sections 29*a*, 29*b*, and the center sealing disc 32*a*, as well as the outer discs 32*b*, 32*c*, and, as selected the electrical precontrol valves, the following described valve functions and other functions in addition are easily adjustable. The single-piece floor seal 4 exhibits, for example, a passage opening 49 and a closure stopper 50 symmetrically to the symmetry axis 48 for the pressure line P.

In addition, the single-piece floor seal 4, resting at the first longitudinal side 2, exhibits at least removable stoppers 51 at the positions of the control lines Z or X and at the ventilation openings R and/or S.

In detail at least the following functions can be easily adjusted by the customer based on the construction of the multifunction multiport slider valve.

1. The function magnet/air spring, internal ventilation:
   the center sealing disc 32*a* is set to "open passage";
   compressed air is fed through the line P and via the cross channel 36 and via the two outer open sealing discs 32*b* and 32*c* to the valve pistons 10 and 11; A pilot valve in position in case of removed sealing disc 32*b*.
2. The function magnet/air spring, external ventilation:
   the center sealing disc 32*a* is set to "open passage";
   compressed air is fed through the control line Z and via both sealing discs 32*b* and 32*c* set to the "open" position, and via the center sealing disc 32*a*, set to the "open" position, onto the valve pistons 10 and 11; a pilot valve 52 is placed in position in case of removed sealing disc 32*b*.
3. The function magnet/magnet, internal ventilation:
   the center sealing disc 32*a* is set to "open passage",
   the pre-control pilot valves 52 are connected to the recesses 43;
   compressed air is fed to the valve pistons 10 and 11 via the line P.
4. The function magnet/magnet, external ventilation:
   the control line Z is subjected to control air;
   the pressure line P is closed;
   the center sealing disc 32*a* is set to "open passage";
   the two outer sealing discs 32*b* and 32*c* are removed and in each case a pre-control pilot valve 52 is put into position.

The function magnet/air spring, embodiment with two pressures:
the ventilation lines R or S are open;
the pressure line P is closed;
the center sealing disc 32*a* is set to "open passage";
the outer sealing disc 32*c* is set to "open passage";
pilot valve 52 is put into position at the outer sealing disc 32*b;*
the main air is applied at the ventilation lines R and S.

6. A function magnet/magnet, embodiment with two pressures:
   the ventilation lines R or S are open;
   the pressure line P is closed;
   the center sealing disc 32*a* is set to "open passage";
   in each case a pilot valve 52 is set onto the two outer recesses 43.
7. The function pneumatically actuated/air spring:
   the control line Z is open;
   the pressure line P is closed;
   the center sealing disc 32*a* is closed;
   the two outer sealing discs 32*b* and 32*c* are set to "open passage".
8. The function pneumatic/pneumatic:
   the control line Z is open;
   the pressure line P is closed;
   the control line Y is subjected to pressure
   the center sealing disc 32*a* is blocked;
   the two outer sealing discs 32*b* and 32*c* are set to "open passage".

Further functions, such as for example,
magnet/magnet, embodiment with two pressures and external ventilation;
pneumatic/air spring, embodiment with two pressures;
pneumatic/pneumatic, embodiment with two pressures, or
magnet/magnet with two different external ventilation pressures are also advantegeous for the expansion of the settings to be furnished by the customer side itself. The possible number of functions is not limited by the examples illustrated here.

A further valve variation with an adjustable spring feedback instead of the illustrated air spring feedback illustrates similar advantages of the free function selection.

It will be understood that each of the elements described above, or two or more together, may also find a useful application in other types of slider valves differing from the types described above.

While the invention has been illustrated and described as embodied in the context of a fluidic multifunction multiport slider valve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A multifunction multiport slider valve comprising a valve casing including a first longitudinal side and a second longitudinal side;

a sealed connection plane disposed on the first longitudinal side of the valve casing;

fluidic supply lines disposed on the sealed connection plane;

control lines disposed on the sealed connection plane;

user lines disposed on the sealed connection plane;

ventilation lines disposed on the sealed connection plane; a support plate provided with connection channels in each case corresponding to the supply lines, the control lines, the user lines, and the ventilation lines;

a valve sleeve disposed centered relative to a valve center longitudinal axis, wherein the valve sleeve is furnished with ring seals coordinated to each passage channel;

a valve slider disposed at the valve sleeve and directed coaxially to the valve sleeve;

a casing bore running parallel to the valve center longitudinal axis at the second longitudinal side, where the second longitudinal side is disposed parallel and opposite to the first longitudinal side, and wherein the casing bore, running parallel to the valve center longitudinal axis, is divided into two separate longitudinal sections; a center sealing disc and outer sealing discs disposed at the second longitudinal side of the valve casing;

independent cross-bores provided in each longitudinal section, wherein the cross bores are directed perpendicular to the valve center longitudinal axis, are running from the casing bore, and are joining at the second longitudinal side;

blocking means for blocking at least the casing bore;

a sealing disc furnished with a passage and disposed in each case in front of the joined openings of the cross bores;

cross channels connected to the pressure line, to the control line, and to the ventilation lines, are led from the first longitudinal side to the two separate longitudinal sections of the casing bore;

a single-piece floor seal for sealing and adjusting the individual cross channels to a respective opening or closing function, wherein the single-piece floor seal can be laterally turned around a center symmetry axis such that, in combination with the casing bore, divided into two longitudinal sections, and the center sealing disc and the outer sealing discs, several valve functions can be easily set in combination with the casing bore.

2. The multifunction multiport slider valve according to claim 1, wherein the structure is constructed for operating on gaseous media.

3. The multifunction multiport slider valve according to claim 1, wherein the two separate longitudinal sections of the casing bore can be fluidically connected and isolated, respectively, by way of the center sealing disc.

4. The multifunction multiport slider valve according to claim 3, further comprising a peripheral channel disposed at the center sealing disc, wherein the peripheral channel extends over an angle of about 180 degrees;

recesses disposed at the valve casing and staggered against each other by 90 degrees;

a projection formed at the center sealing disc, wherein the projection grips in each case into the respective recesses.

5. The multifunction multiport slider valve according to claim 1, further comprising casing covers, wherein the outer sealing discs, disposed in the area the casing covers, are furnished in front of the cross bores, wherein the cross bores join in pairs at the second longitudinal side;

a ball disposed between the cross bores and subdividing one longitudinal section

6. The multifunction multiport slider valve according to claim 1, further comprising a passage flow opening and a closure stopper for the pressure line provided symmetrically to the symmetry axis at the single piece floor seal.

7. The multifunction multiport slider valve according to claim 1, further comprising removable stoppers provided at least at the positions of the control lines and of the ventilation lines at the single-piece floor seal, resting adjacent to the first longitudinal side.

8. The multifunction multiport slider valve comprising a valve casing including a first longitudinal side and a second longitudinal side;

a sealed connection plane disposed on the first longitudinal side of the valve casing;

fluidic supply lines disposed on the sealed connection plane;

control lines disposed on the sealed connection plane;

user lines disposed on the sealed connection plane;

ventilation lines disposed on the sealed connection plane;

a support plate provided with connection channels in each case corresponding to the supply lines, the control lines, the user lines, and the ventilation lines;

a valve sleeve disposed centered relative to a valve center longitudinal axis, wherein the valve sleeve is furnished with ring seals coordinated to each passage channel;

a valve slider disposed at the valve sleeve and directed coaxially to the valve sleeve;

a casing bore running parallel to the valve center longitudinal axis at the second longitudinal side, where the second longitudinal side is disposed parallel and opposite to the first longitudinal side, and wherein the casing bore, running parallel to the valve center longitudinal axis, is divided into two separate longitudinal sections;

a center sealing disc disposed at the second longitudinal side of the valve casing;

independent cross-bores provided in each longitudinal section, wherein the cross bores are directed perpendicular to the valve center longitudinal axis, are running from the casing bore, and are joining at the second longitudinal side;

blocking means for blocking at least the casing bore; a sealing disc furnished with a passage and disposed in each case in front of the joined openings of the cross bores;

cross channels connected to the pressure line, to the control lines, and to the ventilation lines, are led from the first longitudinal side to the two separate longitudinal sections of the casing bore;

a single-piece floor seal for sealing and adjusting the individual cross channels to a respective opening or closing function, wherein the single-piece floor seal can be laterally turned around a center symmetry axis such that, in combination with the casing bore, divided into two longitudinal sections, and the center sealing disc, and several valve functions can be easily set in combination with the casing bore;

at least one pilot valve attached by way of screws, wherein the pilot valve serves for purposes of electric control.

9. A multifunction multiport slider valve, in particular for gaseous media, with a valve casing, which valve casing includes a sealed connection plane for fluidic supply lines, control lines, user lines and ventilation lines at a first longitudinal side, wherein a support plate, including corresponding connection channels is provided for this purpose, wherein a valve sleeve is disposed centered relative to a valve center longitudinal axis, wherein the valve sleeve is furnished with ring seals coordinated to each passage channel, wherein the valve sleeve is furnished with a valve slider disposed co-axially to the valve sleeve, wherein a casing bore runs parallel to the valve center longitudinal axis at a second longitudinal side, where the second longitudinal side is disposed parallel and opposite to the first longitudinal side, wherein cross bores directed perpendicular to the valve center longitudinal axis, run from the casing bore and join at the second longitudinal side, and wherein at least the casing bore can be blocked from the cross bores, wherein the casing bore (29), running parallel to the valve center longitudinal axis (5), is subdivided into two separate longitudinal sections (29*a*, 29*b*), wherein each longitudinal section (29*a*, 29*b*) exhibits independent cross bores (30), which cross bores (30) join at a second longitudinal side (28), wherein in each case a sealing disc (32), furnished with a passage (33), is disposed in front of the joined openings (31) of the cross bores (30), wherein cross channels (36) connected to the pressure line (P), connected to the control line (Z, X), connected to the ventilation lines (R or S) are led from the first longitudinal side (2) to the two separate longitudinal sections (29*a*, 29*b*) of the casing bore (29), and wherein the individual cross channels (36) are adjusted by way of a single-piece floor seal (4) to the respective opening or closing function wherein the single-piece floor seal (4) can be laterally turned around a center symmetry axis (48) such that several valve functions can be easily set in combination with the casing bore (29), subdivided into two longitudinal sections (29*a*, 29*b*), and a center sealing disc (32*a*) and outer sealing discs (32*b* and 32*c*).

10. The multifunction multiport slider valve according to claim 9, wherein the two separate longitudinal sections (29*a*, 29*b*) of the casing bore (29) can be fluidically connected or separated by way of the center sealing disc (32*a*).

11. The multifunction multiport slider valve according to claim 10, wherein the center sealing disc (32*a*) is furnished with a peripheral channel (38), wherein the peripheral channel (38) extends over an angle of about 180 degrees, and wherein a projection (39) is formed at the center sealing disc (32*a*), wherein the projection (39) grips in each case into respective sections (40), which sections (40) are furnished at the valve casing (1) and are staggered against each other by 90 degrees.

12. The multifunction multiport slider valve according to claim 9, wherein the outer sealing discs (32*b*, 32*c*), disposed in the area of a casing cover (19), are furnished in front of cross bores (30), joining in pairs at the second longitudinal side (28), wherein the one longitudinal section (29*a*, 29*b*) is subdivided by way of a ball (23) disposed between the cross bores (30).

13. The multifunction multiport slider valve according to claim 9, wherein the single-piece floor seal (4) is furnished symmetrically to the symmetry axis (48) with a passage flow opening (49) and with a closure stopper (50) for the pressure line (P).

14. The multifunction multiport slider valve according to claim 9, wherein the single-piece floor seal (4), resting adjacent to the first longitudinal side (2), includes removable stoppers (51) at least at the positions of the control lines (Z, X) and of the ventilation lines (R, S).

15. The multifunction multiport slider valve in particular for gaseous media, with a valve casing, which valve casing includes a sealed connection plane for fluidic supply lines, control lines, user lines and ventilation lines at a first longitudinal side, wherein a support plate, including corresponding connection channels is provided for this purpose, wherein a valve sleeve is disposed centered relative to a valve center longitudinal axis, wherein the valve sleeve is furnished with ring seals coordinated to each passage channel, wherein the valve sleeve is furnished with a valve slider disposed co-axially to the valve sleeve, wherein a casing bore runs parallel to the valve center longitudinal axis at a second longitudinal side, where the second longitudinal side is disposed parallel and opposite to the first longitudinal side, wherein cross bores, directed perpendicular to the valve center longitudinal axis run from the casing bore and join at the second longitudinal side, and wherein at least the casing bore can be blocked from the cross bores, wherein the casing bore (29), running parallel to the valve center longitudinal axis (5), is subdivided into two separte longitudinal sections (29*a*, 29*b*), wherein each longitudinal section (29*a*, 29*b*) exhibits independent cross bores (30), which cross bores (30) join at a second longitudinal side (28), wherein in each case a sealing disc (32), furnished with a passage (33), is disposed in front of the joined openings (31) of the cross bores (30), wherein cross channels (36) connected to the pressure line (P), connected to the control line (Z, X), connected to the ventilation lines (R or S) are led from the first longitudinal side (2) to the two separate longitudinal sections (29*a*, 29*b*) of the casing bore (29), wherein the individual cross channels (36) are adjusted by way of a single-piece floor seal (4) to the respective opening or closing function wherein the single-piece floor seal (4) can be laterally turned around a center symmetry axis (48), such that several valve functions can be easily set in combination with the casing bore (29), subdivided into two longitudinal sections (29*a*, 29*b*), and the center sealing disc (32*a*); and wherein at least one pilot relay valve is attached by way of screws (35), wherein the pilot relay valve serves for purposes of electric control.

* * * * *